US006279541B1

(12) United States Patent
Doane et al.

(10) Patent No.: US 6,279,541 B1
(45) Date of Patent: Aug. 28, 2001

(54) FUEL SUPPLY SYSTEM RESPONSIVE TO ENGINE FUEL DEMAND

(75) Inventors: Kirk D. Doane, Essexville; Bryan J. Gettel, Pigeon; Ronald B. Kuenzli, Deford; Peter P. Kuperus, Cass City; Edwyn R. Maschke, Millington; Edward J. Talaski, Caro, all of MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/727,616

(22) Filed: Dec. 1, 2000

(51) Int. Cl.[7] ..... F02M 37/04
(52) U.S. Cl. ..... 123/497; 123/514
(58) Field of Search ..... 123/514, 497, 123/456, 506, 357

(56) References Cited

U.S. PATENT DOCUMENTS

| | | | | |
|---|---|---|---|---|
| 4,800,859 | * | 1/1989 | Sagisaka et al. | 123/497 |
| 5,148,792 | * | 9/1992 | Tuckey | 123/497 |
| 5,265,644 | | 11/1993 | Tuckey | 137/510 |
| 5,337,718 | * | 8/1994 | Tuckey | 123/464 |
| 5,398,655 | | 3/1995 | Tuckey | 123/456 |
| 5,701,869 | * | 12/1997 | Richardson et al. | 123/497 |
| 5,718,207 | * | 2/1998 | Ito | 123/497 |
| 5,765,535 | * | 6/1998 | Radermacher | 123/497 |
| 5,775,304 | * | 7/1998 | Kono et al. | 123/497 |
| 5,785,025 | * | 7/1998 | Yoshiume et al. | 123/497 |
| 5,975,061 | | 11/1999 | Briggs et al. | 123/514 |
| 6,067,963 | * | 5/2000 | Oi et al. | 123/458 |

* cited by examiner

*Primary Examiner*—Carl S. Miller
(74) *Attorney, Agent, or Firm*—Reising, Ethington, Barnes, Kisselle, Learman & McCulloch,P.C.

(57) ABSTRACT

A no-return system for supplying fuel from a tank to a fuel injected internal combustion engine of an automotive vehicle in response to the fuel demand of the engine. The pump supplies more fuel than that required by the operating engine and the excess fuel is diverted from the engine by a bypass fuel pressure regulator and returned to the tank through a fluid-activatable switch movable to electrically open and closed states in response to the rate of flow of excess fuel through the switch. An electric control circuit is responsive to the state of the switch to change the magnitude of the power applied to the electric motor to change its operating speed and thereby modulate the output fuel flow rate of the pump in response to the fuel demand of the engine.

35 Claims, 7 Drawing Sheets

FUEL SUPPLY SYSTEM RESPONSIVE TO ENGINE FUEL DEMAND

FIELD OF THE INVENTION

The invention relates to a fuel supply system for an internal combustion engine of an automobile and, more particularly, to a fuel supply system responsive to engine fuel demand.

BACKGROUND OF THE INVENTION

In the fuel supply system for a fuel injected internal combustion engine present in many modem automotive vehicles, a fuel pump driven by an electric motor continuously supplies liquid fuel to the fuel injector(s) of the engine at a substantially constant flow rate which is always more than sufficient to supply the maximum possible fuel demand of the engine. Thus, under most engine operating conditions and particularly when the engine is merely idling, the fuel pump produces a significant amount of excess fuel that must be returned to the fuel tank from which the fuel pump originally drew the fuel.

Some fuel systems supply the entire fuel output of the pump to the engine and return the excess fuel from the engine to the fuel tank. Other fuel systems divert or bypass the excess fuel before it is delivered to the engine. Such a fuel system is commonly referred to as a "no return" or "returnless" type of system because it neither requires nor has a fuel return line extending from the fuel rail of the engine itself and back to the fuel tank. One prior returnless fuel system is disclosed in U.S. Pat. No. 5,975,061 issued on Nov. 2, 1999 to Briggs et al. In this system, the fuel pump continuously operates at maximum fuel output capacity, and the excess fuel is diverted from the engine and returned to the tank by a bypass fuel pressure regulator which maintains a substantially constant pressure of fuel supplied to the engine even though the fuel flow rate varies.

Another returnless fuel system is disclosed in U.S. Pat. No. 5,265,644 in which changes in the instantaneous pressure of the fuel supplied to the engine actuate a switch to change the speed of the electric motor to vary the fuel output of the pump through appropriate pulse width modulation circuitry which changes the electric power applied to the pump motor.

While these systems do attempt to deliver an amount of fuel to the engine which better matches the actual fuel demand of the engine, they are often inaccurate and untimely, especially when there is a sudden and significant rise or fall in the fuel demand of the engine, and sometimes momentarily result in insufficient fuel being supplied to the engine. Thus, there is a present need in the art for an apparatus which better and more rapidly and timely matches the actual fuel demand of the engine.

SUMMARY OF THE INVENTION

A fuel supply system with a bypass fuel pressure regulator, a fluid-activatable switch responsive to bypass fuel flow, and an associated electric control circuit to vary and modulate the speed of an electric motor driving a fuel pump and hence its output fuel flow rate in accordance with the fuel demand of an internal combustion engine. Preferably, the fluid-activatable switch is manipulable into one of either an electrically open state or an electrically closed state, as determined by the flow rate of excess fuel from the bypass fuel pressure regulator. Preferably, the control circuit is capable of adjusting the level of the voltage supplied to the electric fuel pump motor as dictated by the position of the fluid-activatable switch. In this way, the speed of the electric motor and fuel pump output is modulated in accordance with changes in both the flow of the fuel and the state of the switch.

In a preferred embodiment of the present invention, the fluid-activatable switch has a plunger movable relative to an electrical contact to change the state of the switch in response to the flow rate of excess fuel. The plunger is slidably received in an elongate chamber in a body having an inlet opening at one end, a stop opening at the opposite end, and at least one outlet opening, all communicating with the elongate chamber. Preferably, the plunger is yieldably biased by a resilient biasing element with an adjustable stop member. The stop member is received within the stop opening and has an exposed head portion and a tail portion extending into the chamber. Preferably, the biasing element is a spring with one end abutting the stop member and the other end extending into the chamber and bearing on the plunger. Preferably, the plunger has a shoulder portion, opposite the biased end and proximate each outlet opening in the body, and a single electrically conductive contact mounted on the shoulder portion proximate the inlet opening. The switch also preferably includes a pair of electrically conductive contacts electrically connected to the electric control circuit and mounted and exposed within the chamber of the body, substantially between the inlet opening and each outlet opening. In such a configuration, the chamber of the body defines a fuel flow path from the inlet opening to each outlet opening. The single contact and the shoulder portion of the plunger are situated within the fuel flow path and yieldably biased against any fuel flowing within the fuel flow path. In this way, the plunger is capable of being moved as dictated by the excess fuel flowing within the fuel flow path such that the switch is in one of either the electrically open state or the electrically closed state or position.

Preferably, the electric voltage control circuit includes means for both electrically sensing the state of the fluid-activatable switch and selectively connecting a resistive circuit element such as a resistor in electrical series with the electric fuel pump motor to an electric power source as dictated by the sensed state of the switch. Most preferably, the position sensing and selective connecting means includes a transistor such as, for example, a field-effect transistor.

Objects, features, and advantages of this invention include an electric motor fuel pump system which provides improved efficiency, improved responsiveness to varying engine fuel demand, always satisfies the engine fuel demand, and is compact, rugged, durable, of relatively simple design and economical manufacture and assembly, and in service has a long usefull life.

BRIEF DESCRIPTION OF THE DRAWINGS

These and other objects, features, and advantages of this invention will be apparent from the following detailed description of the preferred embodiments and best mode, appended claims, and accompanying drawings in which:

DETAILED DESCRIPTION OF THE PREFERRED EMBODIMENTS

Figure 1:
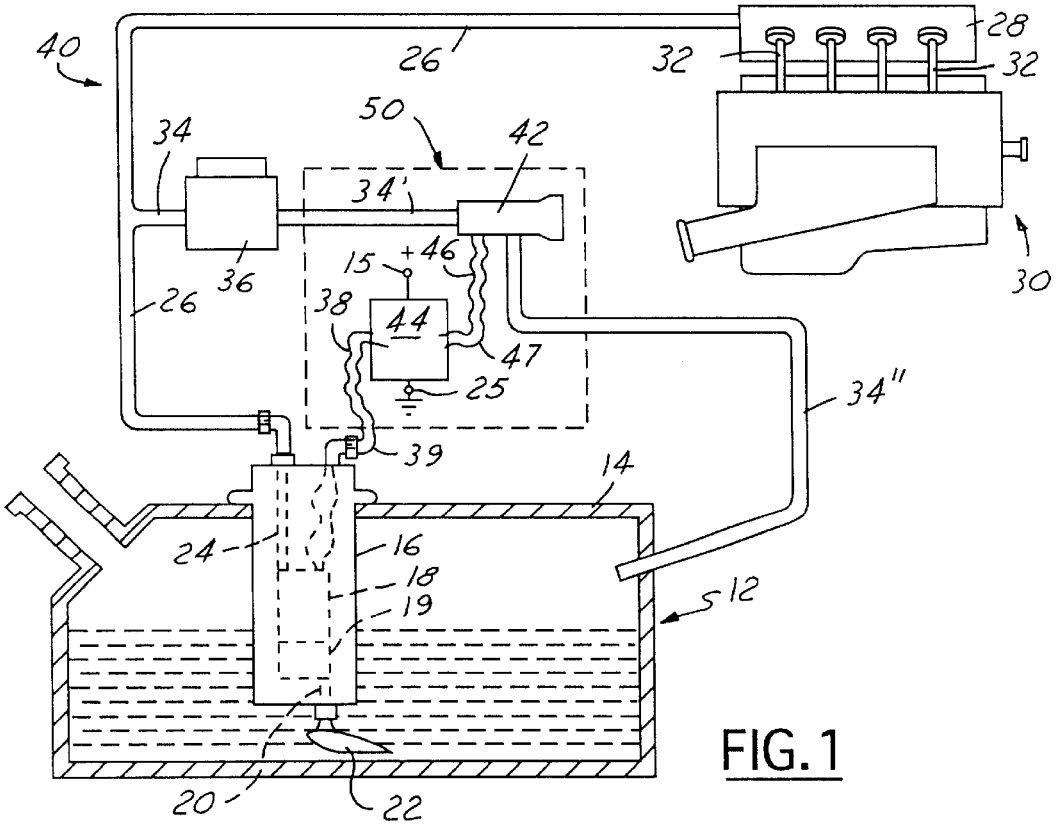
FIG. 1 is a partial sectional view of a fuel supply system for a fuel injected internal combustion engine of an automobile, according to the present invention.

Referring in more detail to the drawings, FIG. 1 illustrates a returnless fuel supply system 40 embodying this invention for supplying fuel from a tank 12 to a fuel rail 28 and fuel injectors 32 of an internal combustion engine 30 preferably of an automotive vehicle. Fuel is supplied from the tank 12 to the rail 28 by a fuel pump module 16 mounted on the top wall 14 of the tank 12. To control the pressure of the fuel, excess fuel supplied by the pump module 16 is diverted from the engine 30 by a bypass pressure regulator 36 and returned to the fuel tank 12 through a fluid-activatable switch 42. An electric control circuit 44 in conjunction with the switch 42 provides an apparatus 50 for modulating the speed of an electric fuel pump motor 18 and hence the speed and output of a fuel pump 19 of the module 16 to vary the fuel flow rate of the operating fuel pump 19.

From the tank 12, the pump 19 draws fuel through a fuel inlet 20 and a filter 22 disposed adjacent the bottom of the tank 12 and supplies fuel under pressure to the fuel rail 28 through a pump outlet 24 and a connecting fuel supply line 26. The inlet of the bypass fuel pressure regulator 36 is connected to the line 26 by a branch fuel bypass line or conduit 34, and the outlet of the bypass regulator 36 is connected to the inlet of the switch 42 by a line 34'. The outlet of the switch 42 communicates with the fuel tank 12 to return fuel to the tank 12 through a line 34".

The electric voltage control circuit 44 is electrically connected to the switch 42 via electrical wires 46 and 47 and electrically connected to the electric fuel pump motor 18 via electrical wires 38 and 39. The electric voltage control circuit 44 is also electrically connected to both a positive power node 15 and a negative power node 25 of an electric power source of the electrical system of the automobile. In such a configuration, the electric voltage control circuit 44 is thereby capable of supplying a current to the electric fuel pump motor 18 for successfully operating the motor 18.

The fluid-activatable switch 42 of FIG. 1 is manipulable into one of either an electrically open position or an electrically closed position, as determined by the flow of the fuel from the bypass fuel pressure regulator 36. The electric voltage control circuit 44 is capable of adjusting the level of the voltage supplied to the electric fuel pump motor 18 as dictated by the position of the fluid-activatable switch 42. In this way, the speed of the electric fuel pump motor 18 is modulated in accordance with changes in both the flow rate of excess fuel through the fuel bypass line 34 and the position of the switch 42.

Figure 2:
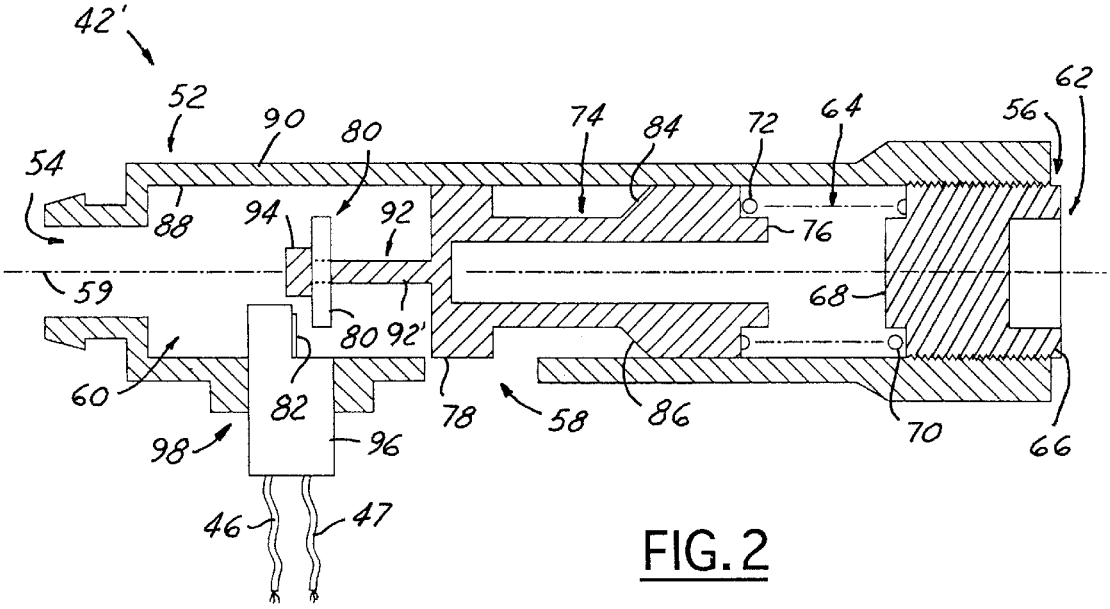
FIG. 2 is a sectional view of a first embodiment of a fluid-activatable switch of the system of FIG. 1.

As shown in FIG. 2, a first embodiment 42' of the fluid-activatable switch 42 has an elongate body 52 with an inlet opening 54 at one end, a stop opening 56 at the opposite end, at least one outlet opening 58, and a longitudinal chamber 60 in communication with the inlet opening 54, the stop opening 56, and each outlet opening 58. The longitudinal chamber 60 is preferably substantially cylindrical and has a longitudinal axis 59 with which both the inlet opening 54 and the stop opening 56 are preferably substantially aligned. Although only one outlet opening 58 is illustrated in FIG. 2, it is to be understood that more than one outlet opening may be provided through the wall 90 of the elongate body 52. Where there is more than one outlet opening 58, each outlet opening 58 is most preferably provided within a common middle section of the elongate body 52 to facilitate the even flow of fuel through the switch 42' for precise calibration of the switch 42'.

The switch 42' also includes an adjustable stop member 62 and an elastic, resilient biasing element 64. The stop member 62 is received within the stop opening 56 and has an exposed head portion 66 and a tail portion 68 extending into the chamber 60. The stop member 62 is a threaded plug received in a complimentary mating threaded portion of the opening 56 to facilitate precise adjusting of the stop member 62 within the longitudinal chamber 60 of the elongate body 52 for operational calibration of the switch 42'. As an alternative to a plug, the stop member 62 may be a cup-shaped closure.

A plunger 74 is slidably received in the chamber 60 and yieldably biased toward an extended position by the biasing element 64, which in this embodiment is a helical spring. The biasing element 64 has one end 70 bearing on and received over the tail portion 68 of the stop member 62 and the other end 72 bearing on and received over a biased end 76 of the plunger 74. A single electrically conductive contact 80, preferably in the form of an annular metal disc 80', is mounted on a stem 92 axially extending from a shoulder portion 78 of the plunger 74 proximate the inlet opening 54. The biased end 76 of the plunger 74 has a plurality of integral and circumferentially spaced apart fins 84 and 86 in smooth sliding contact with the inner surface 88 of the wall 90 of the elongate body 52. Similarly, the shoulder portion 78 of the plunger 74 is substantially cylindrical and has a cross-sectional area that approaches the cross-sectional area of the longitudinal chamber 60. In this way, smooth sliding contact between the shoulder portion 78 of the plunger 74 and the inner surface 88 of the wall 90 of the elongate body 52 is facilitated as well.

Figure 7:
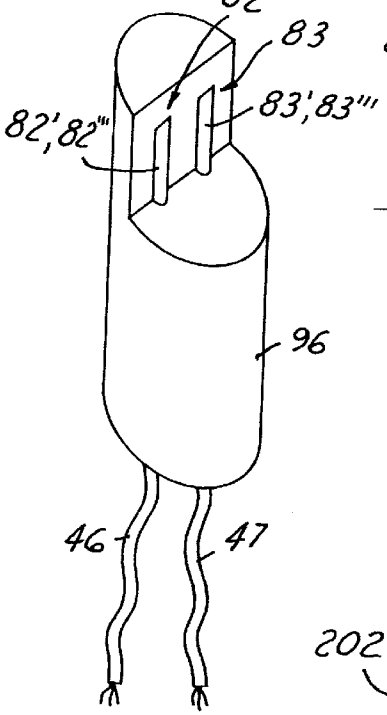
FIG. 7 is a perspective view of a plug suitable for use with the first embodiment of the switch of FIG. 2 and the third embodiment of the switch of FIG. 5.

The switch 42' has a pair of electrically conductive contacts 82 and 83 electrically connected via electric wires 46 and 47 to the electric voltage control circuit 44. The contacts 82 and 83 are mounted and exposed within the chamber 60 of the body 52, substantially between the inlet opening 54 and the outlet opening 58. As shown in FIG. 7, the contacts 82 and 83 are preferably a pair of metal prongs 82' and 83' mounted in an insulative plug casing 96 such that the metal prongs 82' and 83' are at least partially exposed within the longitudinal chamber 60. As shown in FIG. 2, the plug casing 96 is received and sealed in an opening 98 in the body 52.

The chamber 60 of the body 52 defines a fuel flow path from the inlet opening 54 to the outlet opening 58. The single contact 80 and the shoulder portion 78 of the plunger 74 are situated within the fuel flow path and yieldably biased against any fuel flowing within the fuel flow path. In this way, the plunger 74 is capable of being moved as dictated by the fuel flowing within the fuel flow path such that the switch 42' is in one of either an electrically open position or an electrically closed position. In the open position, the single contact 80 is spaced from the pair of contacts 82 and 83. In the closed position, the single contact 80 bears on and is in electrical contact with the pair of contacts 82 and 83.

Figure 4:
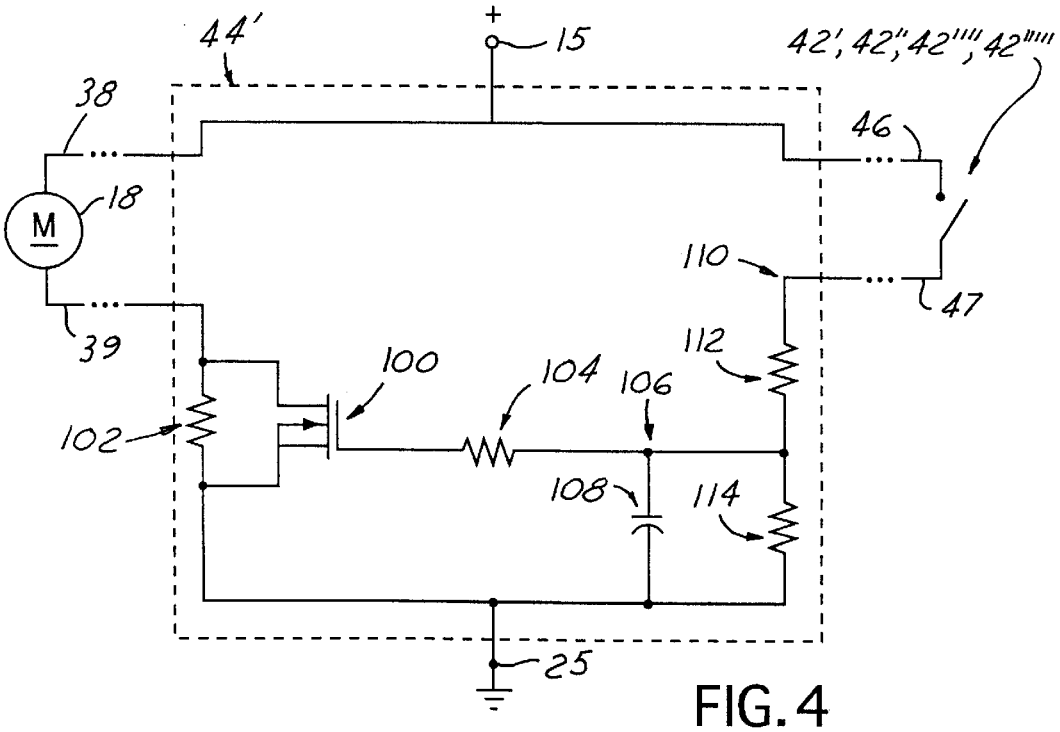
FIG. 4 is an electric circuit diagram for a first embodiment of an electric voltage control circuit of the system of FIG. 1.

FIG. 4 illustrates a first embodiment 44' of the electric voltage control circuit 44 of FIG. 1 and is suitable for use with the first and second embodiments 42' and 42" of the switch 42 of FIG. 1. The circuit 44' has an electrically resistive circuit element, in this case, a resistor 102, and means for electrically sensing the position of the fluid-activatable switch 42' and selectively connecting the resistor 102 in electrical series with the electric fuel pump motor 18 to the positive power node 15 and the negative power node 25 as dictated by the sensed position of the switch 42'. In this circuit 44', the position sensing and selective connecting means is an n-channel field-effect transistor (FET) 100. It is to be understood, however, that other types of transistors or switching devices may be used instead of an n-channel field-effect transistor.

The electric fuel pump motor 18 is electrically connected between the positive power node 15 via electric wire 38 and the drain of the FET 100 via electric wire 39. The resistor 102 is electrically connected between the drain and the source of the FET 100, and the source of the FET 100 is electrically connected to the negative power node 25. The fluid-activatable switch 42' is electrically connected between the positive power node 15 via electric wire 46 and a circuit node 110 via electric wire 47. A resistor 112 is electrically connected between the circuit node 110 and a circuit node 106. A capacitor 108 and a resistor 114 are electrically connected in parallel between the circuit node 106 and the negative power terminal 25. A resistor 104 is electrically connected between the gate of the FET 100 and the circuit node 106.

During operation of the fuel supply system 40 of FIG. 1, the fuel pump 19 draws fuel from within the fuel tank 12 through the filter 22 and the fuel inlet 20 and thereafter delivers the fuel through the fuel outlet 24 under pressure to the fuel supply line 26. The line 26 supplies a portion of the fuel under pressure to the fuel rail 28 and associated fuel injectors 32 of the internal combustion engine 30. In doing so, the fuel pump 19 normally maintains an output fuel pressure and fuel flow rate at the outlet 24 which is greater than that required to meet the fuel demand of the operating engine 30. At least most of the time, the fuel pump 19 provides an amount of fuel that exceeds the actual fuel demand of the engine 30 during operation, and the bypass fuel pressure regulator 36 then, under pressure, diverts the excess fuel flow from the line 26 and returns the excess fuel via the fuel bypass line 34 and switch 42' back to the fuel tank 12. If the fuel pump 19 provides an amount of fuel that closely matches the fuel demand of the engine 30, then the bypass fuel pressure regulator 36 diverts little to no excess fuel into the fuel bypass line 34 and the switch 42'.

Thus, when the fuel demand of the engine 30 is high, such as during times when the automobile rapidly accelerates or the engine operates under a great load, the bypass fuel pressure regulator 36 then diverts little to no fuel into the fuel bypass line 34 to insure that the high fuel demand of the engine is met. This dictates that little to no fuel will enter the inlet opening 54 of the switch 42' and thus the force, if any, exerted by the excess fuel against the metal annular disc 80' and the shoulder portion 78 of the plunger 74 will not be sufficient to counteract and overcome the bias of the biasing element 64 against the plunger 74. As a result, the switch 42' will remain in an electrically closed position wherein the metal annular disc 80' rests against both metal prongs 82' and 83' and thereby electrically shorts or connects the metal prongs 82' and 83' together.

Referring to FIG. 4, when the switch 42' is in an electrically closed position during times when the engine 30 has a relatively high fuel demand, a high electrical signal supplied by the positive power node 15 passes through the closed switch 42' and the resistor 112 to the circuit node 106. After reaching the circuit node 106, the capacitor 108 is charged up, and the high electrical signal is divided between the resistor 104 and the resistor 114 such that a high enough electrical signal reaches the gate of the FET 100 to thereby induce the FET 100 into conduction mode. In the conduction mode, the FET 100 thereby permits the conduction of current from its drain to its source such that the resistor 102 is essentially electrically shorted out or bypassed. In shorting out the resistor 102, the full voltage potential between the positive power node 15 and the negative power node 25 is applied to the electric fuel pump motor 18. As a result, the electric fuel pump motor 18 will then operate at full speed to ensure that enough fuel is pumped from the fuel tank 12 and supplied to the fuel rail 28 to meet the high fuel demand of the engine 30.

On the other hand, when the fuel demand of the engine 30 becomes low, such as when the engine is merely idling, a significant amount of excess fuel provided by the fuel pump 19 to the fuel supply line 26 is diverted by the bypass fuel pressure regulator 36 into the fuel bypass line 34 and the inlet opening 54 of the switch 42' and exerts a substantial amount of force against both the metal annular disc 80' and the shoulder portion 78 of the plunger 74 such that the bias of the biasing element 64 against the plunger 74 is counteracted and overcome. As a result, the plunger 74 is retracted against the bias of the biasing element 64 such that switch 42' moves from an electrically closed position to an electrically open position wherein the metal annular disc 80' no longer rests against both of the metal prongs 82' and 83'.

Referring again to FIG. 4, when the switch 42' moves into an electrically open position, the high electrical signal provided by the positive power node 15 is prevented from reaching the gate of the FET 100 since the open switch 42' creates an open circuit condition between the positive power node 15 and the gate of the FET 100. As a result, any high electrical charge stored in the capacitor 108 is discharged through the resistor 114, and the FET 100 is induced into non-conduction mode and therefore prevents the passage of electric current from its drain to its source. Further, electric current moving from the positive power node 15, through the electric fuel pump motor 18, and to the negative power node 25 is thereby forced to pass through the resistor 102 as well. The resultant voltage drop across the resistor 102 thereby reduces the net voltage drop across the electric fuel pump motor 18. Thus, the full voltage potential between the positive power node 15 and the negative power node 25 is not fully applied across the electric fuel pump motor 18. As a result, the electric fuel pump motor 18 will operate at a reduced speed and pump a reduced amount of fuel from the fuel tank 12 that is sufficient for the low fuel demand of the engine 30.

Second Switch

Figure 3:
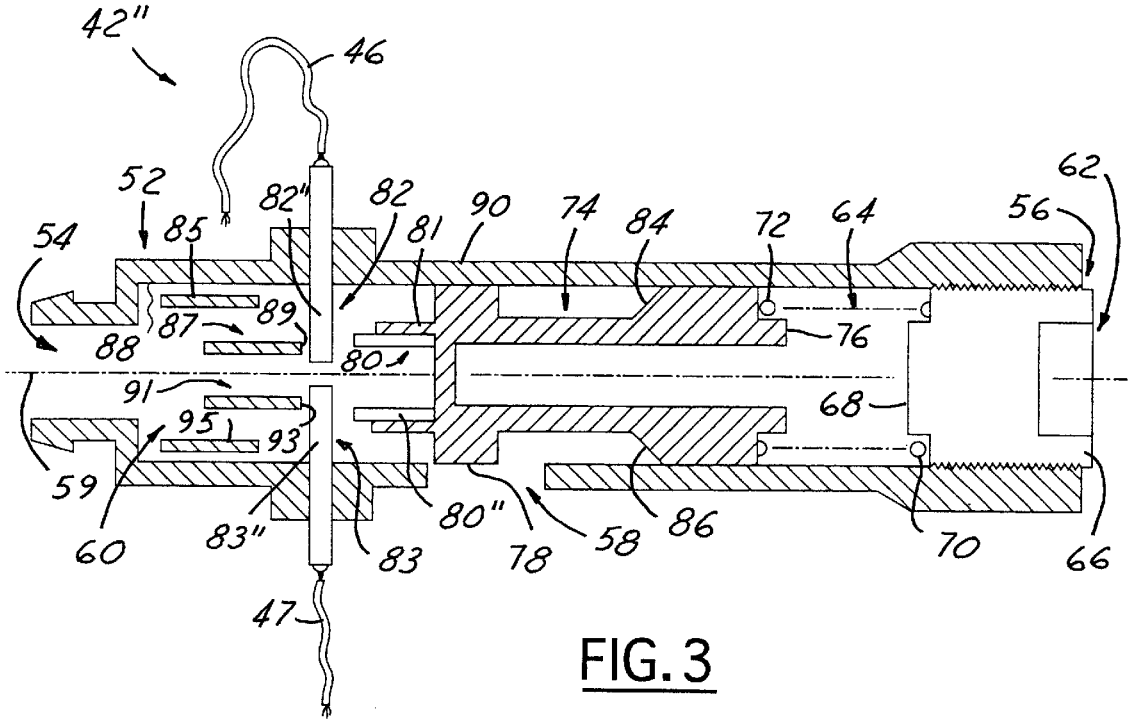
FIG. 3 is a sectional view of a second embodiment of a fluid-activatable switch of the system of FIG. 1.

In a second embodiment, the fluid-activatable switch 42" illustrated in FIG. 3 may be used in the system 40 of FIG. 1 instead of the switch 42' of FIG. 2. The switch 42" is substantially similar to the switch 42' with only a few variations. In particular, the metal annular disc 80' is replaced with a metal cylindrical ring 80" which is fixedly seated in a pocket 81 integral with the shoulder 78 of the plunger 74. Both the metal cylindrical ring 80" and the pocket 81 are situated so that they generally face the inlet opening 54 and the metal cylindrical ring 80" extends axially toward the inlet opening 54 beyond the confines of the pocket 81.

A pair of flexible metal prongs 82" and 83" is sealingly mounted in the insulative wall 90 of the longitudinal chamber 60 so that they are at least partially exposed within the longitudinal chamber 60 and are electrically connected to the electric voltage control circuit 44' via electric wires 46 and 47.

The switch 42" includes laminar flow guide structures or fins 85, 87, 91 and 95 which are integral with the wall 90 of the longitudinal chamber 60. The guide structures 85, 87,91 and 95 extend longitudinally and are particularly situated within the chamber 60 proximate the inlet opening 54 and in the fuel flow path between the inlet opening 54 and the outlet opening 58. The guide structures 87 and 91 have stop surfaces 89 and 93 for physically limiting the range of flexing of the flexible metal prongs 82" and 83" when the cylindrical metal ring 80" carried by the plunger 74 is biased against both of the flexible metal prongs 82" and 83" when the switch 42" is in an electrically closed position.

Operation of the second switch 42' is substantially the same as the operation of the first switch 42' described earlier hereinabove and thus will not be repeated herein.

Third Switch and Second Circuit

Figure 5:
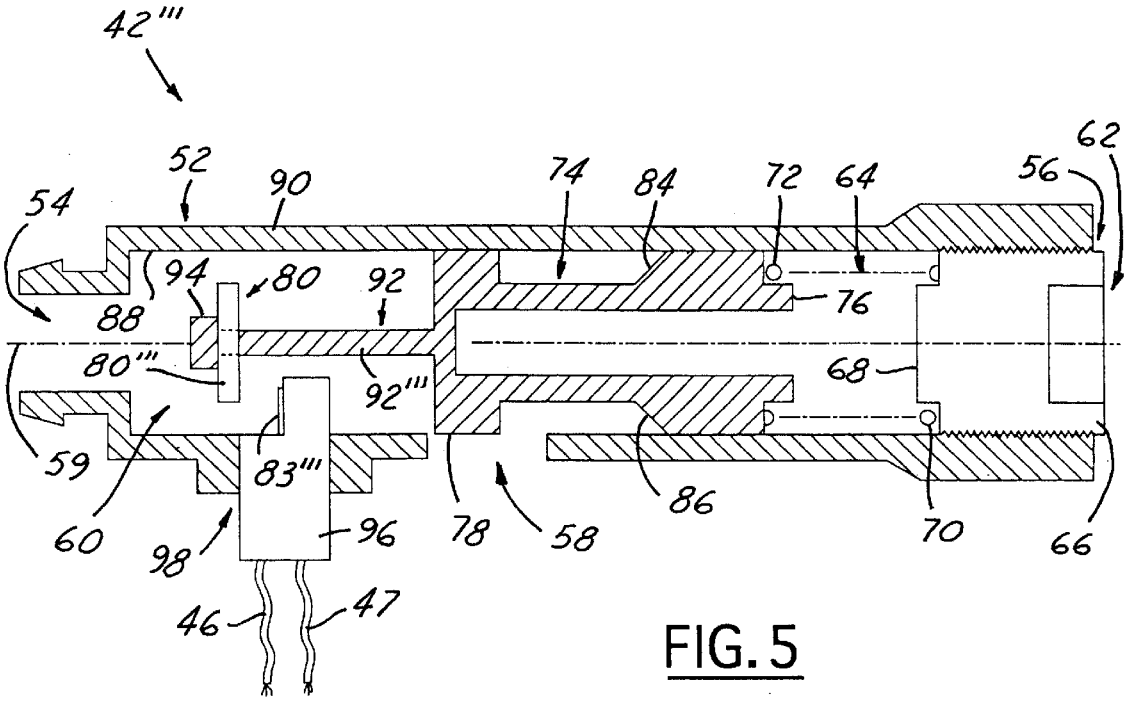
FIG. 5 is a sectional view of a third embodiment of a fluid-activatable switch of the system of FIG. 1.
Figure 6:
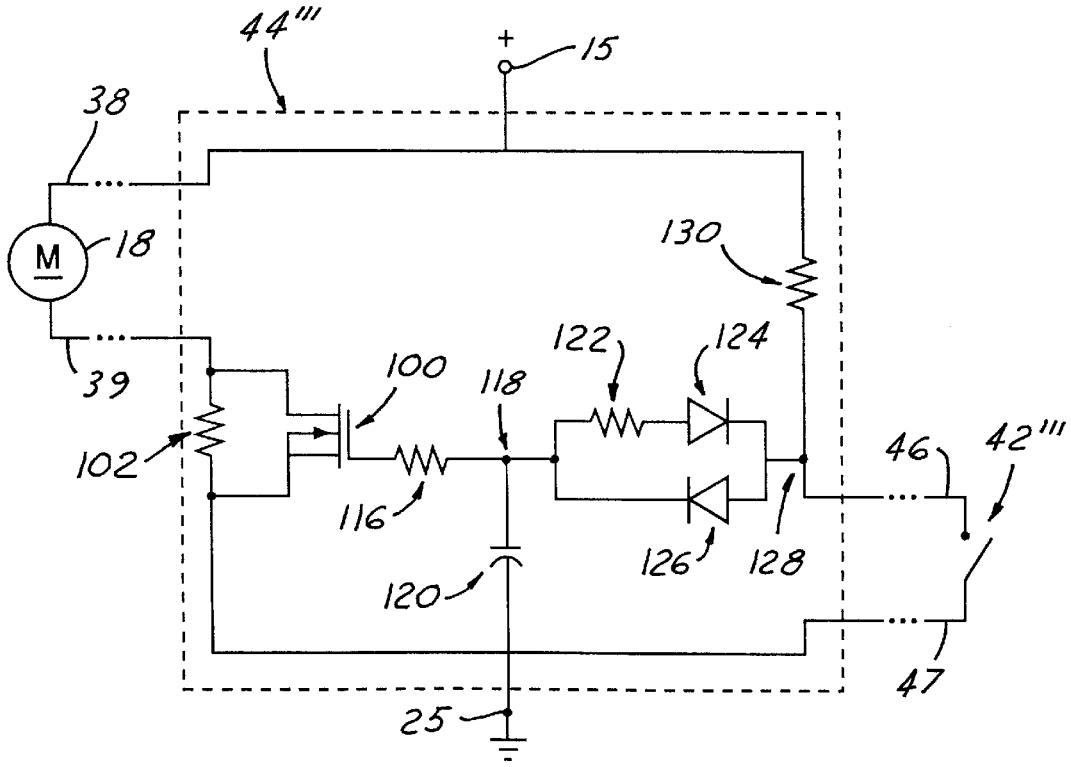
FIG. 6 is an electric circuit diagram for a second embodiment of an electric voltage control circuit of the system of FIG. 1 and suitable for use with the third embodiment of the switch of FIG. 5.

A third embodiment of a fluid-activatable switch 42'" illustrated in FIG. 5 and a second embodiment of an electric voltage control circuit 44'" illustrated in FIG. 6 may be used in the system of FIG. 1 instead of the switch 42' and the electric voltage control circuit 44'.

As shown in FIG. 5, the switch 42'" is substantially similar to the switch 42' with only a few variations. In particular, the stem 92'" of this switch 42'" is substantially longer than the stem structure 92' of switch 42' and has a metal annular disc 80'" adjustably fixed on its extended end which is generally disposed between the inlet opening 54 and the insulative plug casing 96 with metal prongs 82'" and 83'". The plug casing 96 is rotated 180° and disposed downstream of the metal annular disc 80'". With this configuration, the switch 42'" is in an electrically open position when the force of little to no fuel flow is exerted against the metal annular disc 80'" and the shoulder portion 78 of the plunger 74 and is in an electrically closed position when the fuel flow produces a sufficient force to move the plunger 74 sufficiently so that the disc 80'" simultaneously bears on both of the metal prongs 82'" and 83'".

As shown in FIG. 6, the electric voltage control circuit 44'" has an electrically resistive circuit element, in this case the resistor 102, and means for electrically sensing the position of the fluid-activatable switch 42'" and selectively connecting the resistor 102 in electrical series with the electric fuel pump motor 18 to the positive power node 15 and the negative power node 25 as dictated by the sensed position of the switch 42'". In this circuit, the position sensing and selective connecting means comprises the n-channel field-effect transistor (FET) 100. It is to be understood, however, that other types of transistors or switching devices may be used instead of an n-channel field-effect transistor.

The electric fuel pump motor 18 is electrically connected between the positive power node 15 via electric wire 38 and the drain of the FET 100 via electric wire 39. The resistor 102 is electrically connected between the drain and the source of the FET 100, and the source of the FET 100 is electrically connected to the negative power node 25. The fluid-activatable switch 42'" is electrically connected between the negative power node 25 via electric wire 47 and a circuit node 128 via electric wire 46. A resistor 130 is electrically connected between the circuit node 128 and the positive power node 15. The anode of a diode 126 is electrically connected to the circuit node 128, and the cathode of the diode 126 is electrically connected to a circuit node 118. In parallel therewith, a resistor 122 and a diode 124 are serially connected between the circuit node 118 and the circuit node 128 such that the anode of the diode 124 is electrically connected to the resistor 122 and the cathode of the diode 124 is electrically connected to the circuit node 128. A capacitor 120 is electrically connected between the circuit node 118 and the negative power node 25 while a resistor 116 is electrically connected between the circuit node 118 and the gate of the FET 100.

In operation, when the fuel demand of the engine 30 is low, fuel diverted by the bypass fuel pressure regulator 36 into the fuel bypass line 34 enters the inlet opening 54 of the switch 42'" and exerts sufficient force against both the metal annular disc 80'" and the shoulder portion 78 of the plunger 74 to overcome the bias of the biasing element 64 against the plunger 74 and move the metal annular disc 80'" against both of the metal prongs 82'" and 83'" mounted in the plug casing 96. When this occurs, the metal prongs 82'" and 83'" are electrically shorted or connected together such that switch 42'" is in an electrically closed position.

As shown in FIG. 6, when the switch 42'" is in an electrically closed position when the fuel demand of the engine 30 is low, electric current from the positive power node 15 flows through the resistor 130, through the closed switch 42'", and down to the negative power node 25. That is, the closed switch 42'" electrically shorts out a significant portion of the electric voltage control circuit 44'" such that a high electrical signal is not able to reach the gate of the FET 100. Thus, the FET 100 is left in non-conduction mode and will not allow the passage of electric current from the drain to the source of the FET 100. As a result, electric current moving from the positive power node 15, though the electric fuel pump motor 18, and to the negative power node 25 is thereby forced to pass through the resistor 102 as well and the resultant voltage drop across the resistor 102 thereby reduces the net voltage applied to the electric fuel pump motor 18. That is, the full voltage potential between the positive power node 15 and the negative power node 25 is not fully applied to the electric fuel pump motor 18. As a result, the electric fuel pump motor 18 will operate at a reduced speed and the pump will deliver a reduced amount and flow rate of fuel from the fuel tank 12 that is sufficient for the low fuel demand of the engine 30.

When the fuel demand of the engine 30 is high, the bypass fuel pressure regulator 36 then diverts little to no fuel into the fuel bypass line 34 to ensure that the high fuel demand of the engine 30 is met. The low flow rate or lack of excess fuel within the fuel bypass line 34, however, dictates that little to no excess fuel will enter the inlet opening 54 of the switch 42'" of FIG. 5. Thus, the force of the excess fuel, if any, exerted against the metal annular disc 80'" and the shoulder portion 78 of the plunger 74 will not be sufficient to overcome the bias of the biasing element 64 against the plunger 74. As a result, the switch 42''' will be in an electrically open position wherein the metal annular disc 80''' no longer rests against both metal prongs 82''' and 83'''.

As shown in FIG. 6, when the switch 42''' is in an electrically open position during a time when the engine 30 has a high fuel demand, a high electrical signal supplied by the positive power node 15 passes through the resistor 130, the diode 126, and the resistor 116 so that a high enough electrical signal reaches the gate of the FET 100 to thereby induce the PET 100 into conduction mode. As the high electrical signal reaches the gate of the FET 100, the capacitor 120 begins to charge up so that the high electrical signal at the gate of the FET 100 is properly maintained. In the conduction mode, the FET 100 thereby permits the conduction of current from its drain to its source so that the resistor 102 is essentially electrically shorted out and thus the full voltage potential between the positive power node 15 and the negative power node 25 is applied to the electric fuel pump motor 18. As a result, the electric fuel pump motor 18 will then operate at full speed to ensure that enough fuel is pumped from the fuel tank 12 and supplied to the fuel rail 28 to meet the high fuel demand of the engine 30. When the switch 42''' is subsequently closed, for example, due to a sudden decrease in fuel demand from the engine 30, the capacitor 120 will then begin to discharge its high voltage potential through the resistor 122, the diode 124, and the closed switch 42''' until there is no longer a high electrical signal at the gate of the FET 100 and the FET 100 eventually enters into non-conduction mode again.

Fourth Switch

Figure 8:
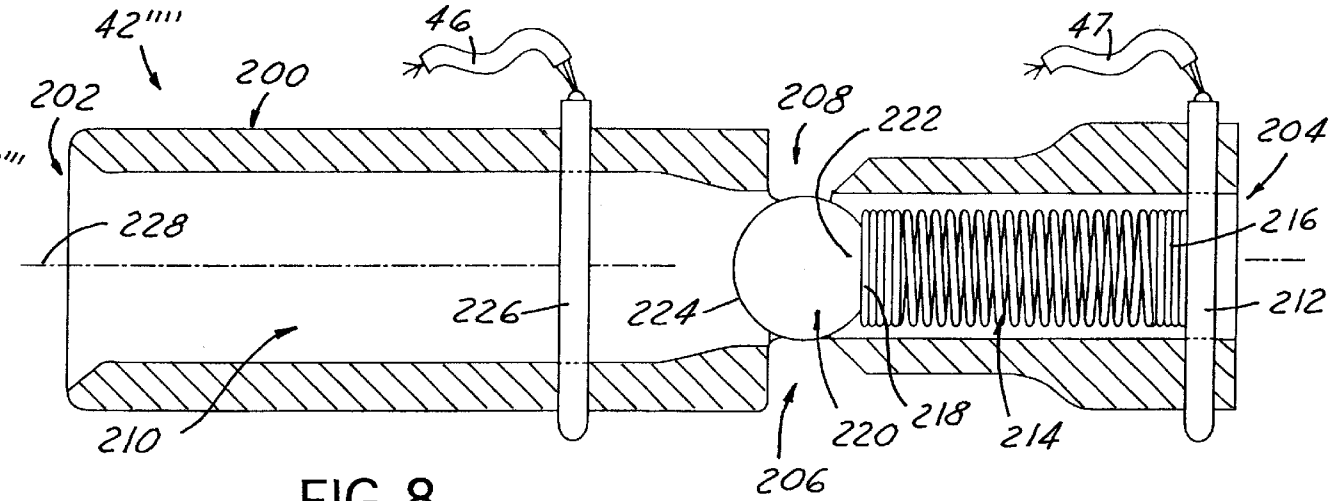
FIG. 8 is a sectional view of a fourth embodiment of a fluid-activatable switch of the system of FIG. 1, wherein the switch is in an electrically open position.
Figure 9:
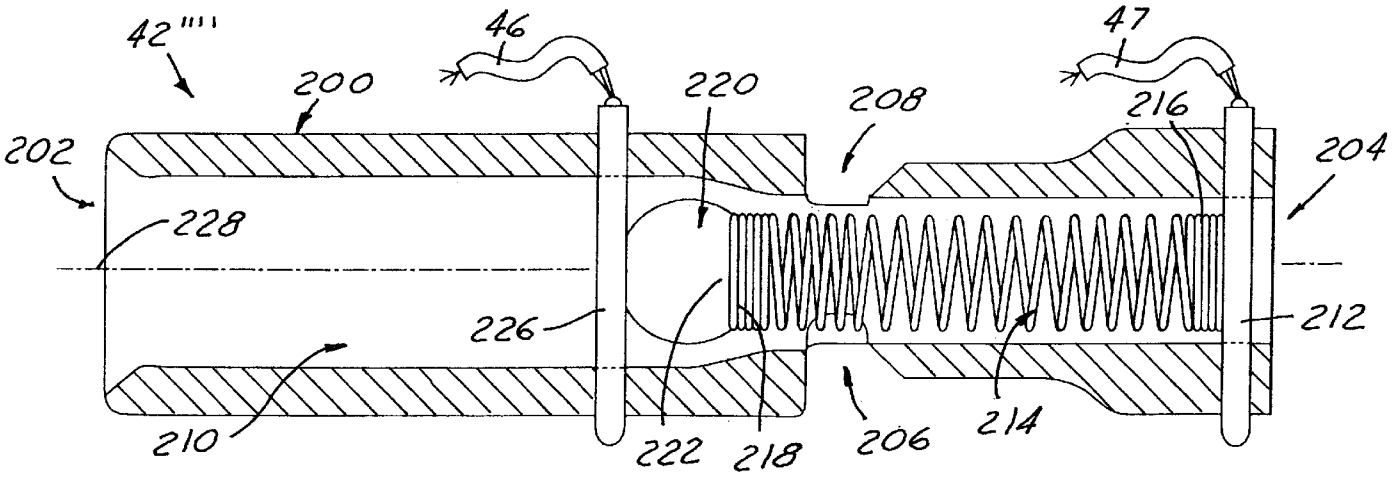
FIG. 9 is another sectional view of the fluid-activatable switch of FIG. 8, wherein the switch is in an electrically closed position.

A fourth embodiment of a fluid-activatable switch 42'''' illustrated in FIGS. 8 and 9 may be used in the system 40 of FIG. 1 with the first electric voltage control circuit 44' of FIG. 4. The fluid-activatable switch 42'''' has an elongate body 200 with an inlet opening 202 at one end, an end outlet opening 204 at the opposite end, side outlet openings 206 and 208, and a longitudinal chamber 210. The longitudinal chamber 210 communicates with the inlet opening 202, the end outlet opening 204, and the side outlet openings 206 and 208. The switch 42'''' has an electrically conductive first contact 212 and an electrically conductive resilient biasing element 214 which, in this embodiment, is a spring. The first contact 212 is electrically connected to the electric voltage control circuit 44' (see FIG. 4) and is also mounted and exposed within the chamber 210 of the body 200 proximate the end outlet opening 204. The electrically conductive biasing element 214 has one end 216 electrically attached to the first contact 212 and the other end 218 extending into the chamber 210 and bearing on a plunger 220 in the form of an electrically conductive ball preferably of metal. The plunger 220 is slidingly received within the chamber 210 and preferably has a biased side 222, electrically attached to the end 218 of the biasing element 214, and an impact side 224, opposite the biased side 222 and movably situated substantially between the inlet opening 202 and the side outlet openings 206 and 208 in the body 200. The switch 42'''' also has an electrically conductive second contact 226 electrically connected to the electric voltage control circuit 44' and mounted and exposed within the chamber 210 of the body 200, substantially between the inlet opening 202 and the side outlet openings 206 and 208. In this configuration, the chamber 210 of the body 200 defines a fuel flow path from the inlet opening 202 to the outlet openings 206 and 208. The plunger 220 is situated within the fuel flow path and yieldably biased against any fuel flowing within the fuel flow path. In this way, the plunger 220 is capable of being moved as dictated by the rate of fuel flowing through the fuel flow path so that the switch 42'''' is in one of either an electrically open position or an electrically closed position. The open position or state is particularly defined as the plunger 220 being separated from the second contact 226, and the closed position or state is particularly defined as the plunger 220 being in electrical contact with the second contact 226.

As illustrated in FIGS. 8 and 9, the chamber 210 of the switch 42'''' has a venturi shape and is substantially cylindrical from the inlet opening 202 to the electrically conductive second contact 226 and then tapered with a generally frusto-conical or funnel shape to the side outlet openings 206 and 208. From the side outlet openings 206 and 208 to the end outlet opening 204, the chamber 210 is substantially cylindrical and has an inner diameter which is smaller than the inner diameter of the chamber 210 from the inlet opening 202 to the second contact 226. The inlet opening 202 and the end outlet opening 204 are substantially aligned with the longitudinal axis 228 of the chamber 210, and each of the side outlet openings 206 and 208 are within a common middle section of the elongate body 200 between the first contact 212 and the second contact 226. In this configuration, fuel flow within the switch 42'''' is more symmetrical and therefore predictable so that critical dimensions that dictate the operational characteristics of the switch 42'''' are more easily calculated and calibrated. The diameter of the plunger 220 substantially approaches the diameter of the longitudinal chamber 210 proximate the side outlet openings 206 and 208. Given such a configuration, dithering or bouncing of the plunger 220 within the chamber 210 as fuel flows therethrough is significantly reduced. As a result, smooth and even flow of fuel through the chamber 210 and through the outlet openings 204, 206, and 208 is thereby facilitated.

In operation, when the fuel demand of the engine 30 is low, a significant amount of excess fuel is diverted by the bypass fuel pressure regulator 36 and introduced into the chamber 210 of the switch 42'''' via the inlet opening 202. The excess fuel exerts a substantial force against the plunger 220 such that the bias of the biasing element 214 is overcome and the plunger 220 moves and becomes separated or spaced from the second contact 226 and the switch 42'''' is moved to an electrically open position. Given such an open circuit condition, the FET 100 in FIG. 4 slips into non-conduction mode, and a lower supply voltage is therefore applied by the electric voltage control circuit 44'''' to the electric fuel pump motor 18. As a result, both the operational speed of the electric fuel pump motor 18 and the amount and flow rate of fuel supplied thereby is reduced to better match the low fuel demand of the engine 30.

When, on the other hand, the fuel demand of the engine 30 is high, relatively little to no fuel is diverted by the bypass fuel pressure regulator 36, and little to no force is exerted against the plunger 220 in the switch 42''''. The plunger 220 is therefore pressed against the second contact 226 by the biasing force of the biasing element 214 as illustrated in FIG. 9. With the plunger 220 pressed against the second contact 226 in this manner, a closed circuit condition is created in the switch 42''''. Given such a closed circuit condition, the FET 100 in FIG. 4 then slips into conduction mode wherein the resistor 102 is electrically shorted out. As a result, a greater supply voltage equal to the full voltage potential between the positive power node 15 and the negative power node 25 is therefore applied to the electric fuel pump motor 18. In this way, both the operational speed of the electric fuel pump motor 18 and the amount of fuel produced by the fuel pump 19 are increased to better match and satisfy the high fuel demand of the engine 30.

Fifth Switch

A fifth embodiment of a fluid-activatable switch 42'''' illustrated in FIGS. 10–13 may be used in the system 40 with the electric voltage control circuit 44' of FIG. 4. The fluid-activatable switch 42'''' has an elongate body 250 having an inlet opening 252 at one end, an end outlet opening 254 at the opposite end, four side outlet openings 255, 256, 257, and 258, and a longitudinal chamber 260. The longitudinal chamber 260 is in communication with the inlet opening 252, the end outlet opening 254, and the four side outlet openings 255, 256, 257 and 258. The switch 42'''' also has an electrically conductive first contact 262 and an electrically conductive biasing element 264 which, in this embodiment, is a metal spring. The first contact 262 is electrically connected to the electric voltage control circuit 44' (see FIG. 4). and is also mounted and exposed within the chamber 260 of the body 250 proximate the end outlet opening 254. The biasing element 264 has a first end 266 electrically attached to the first contact 262 and a second end 268 extending into the chamber 260 and bearing on an electrically conductive plunger 270, preferably a metal ball, slidingly received within the chamber 260. Preferably, the plunger 270 has a biased side 272, electrically attached to the second end 268 of the biasing element 264, and an impact side 274, opposite the biased side 272 and movably situated substantially between the inlet opening 252 and the four side outlet openings 255, 256, 257, and 258 in the body 250. The switch 42'''' has an electrically conductive second contact 276 electrically connected to the electric voltage control circuit 44'. The second contact 276 is mounted and exposed within the chamber 260 of the body 250, substantially between the inlet opening 252 and the four side outlet openings 255, 256, 257, and 258. In such a configuration, the chamber 260 of the body 250 defines a fuel flow path from the inlet opening 252 to the outlet openings 255, 256, 257, and 258. The plunger 270 is situated within the fuel flow path and yieldably biased against any fuel flowing within the fuel flow path. In this way, the plunger 270 is capable of being moved as dictated by the fuel flowing within the fuel flow path such that the switch 42'''' is in one of either an electrically open position or an electrically closed position. In the open position or state, the plunger 270 is separated from the second contact 276, and in the closed position or state, the plunger 270 is in electrical contact with the second contact 276.

Preferably, the diameter of the plunger ball 270 substantially approaches the diameter of the longitudinal chamber 270 proximate the four side outlet openings 255, 256, 257, and 258. Given such a configuration, dithering or bouncing of the plunger 270 within the chamber 260 as significant amounts of fuel flow therethrough is significantly reduced. As a result, smooth and even flow of fuel through the chamber 260 and through the four outlet openings 255, 256, 257, and 258 is thereby facilitated.

Figure 10:
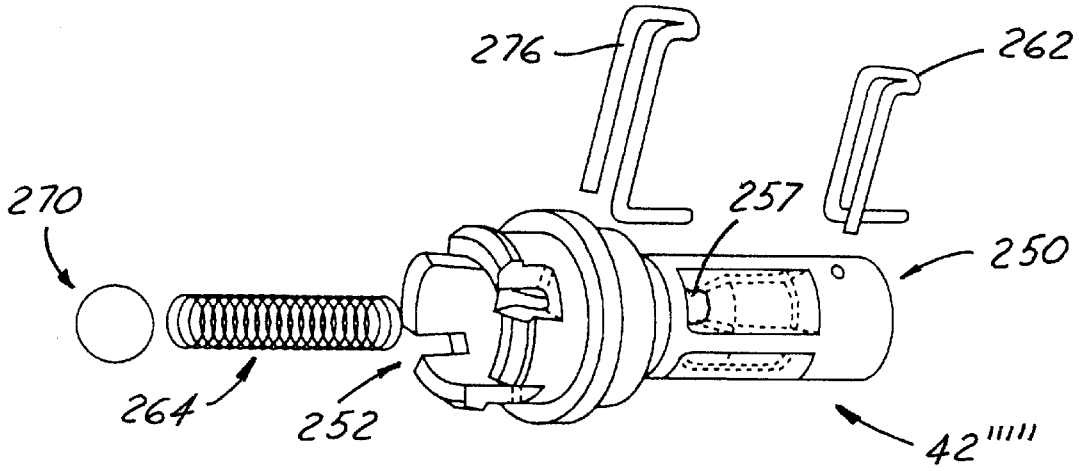
FIG. 10 is an exploded perspective view of a fifth embodiment of a fluid-activatable switch of the system of FIG. 1.
Figure 11:
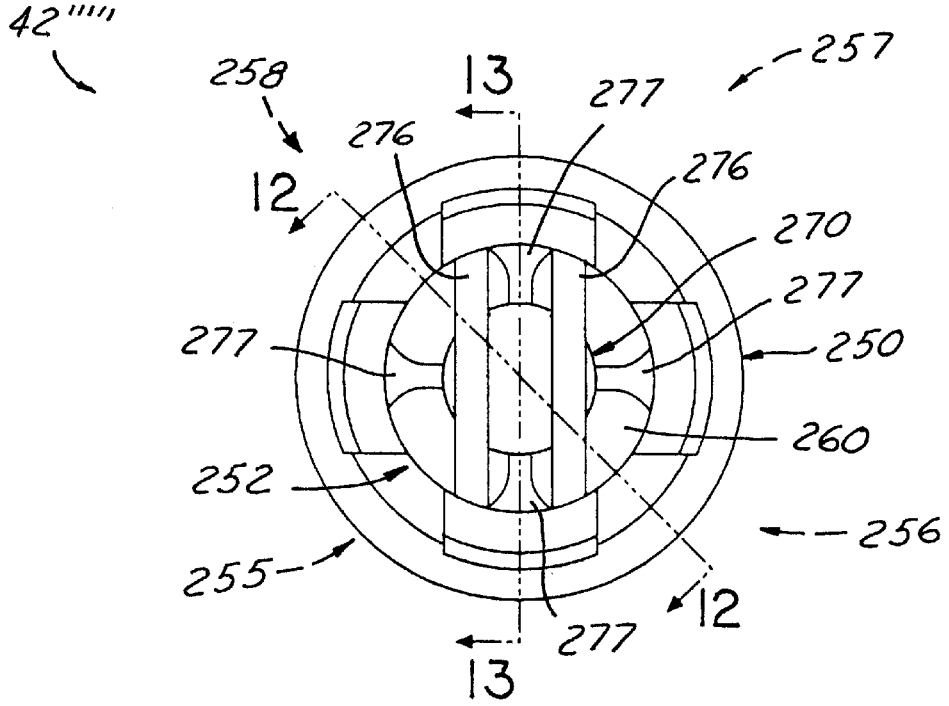
FIG. 11 is an end view of the fluid-activatable switch of FIG. 10.
Figure 12:
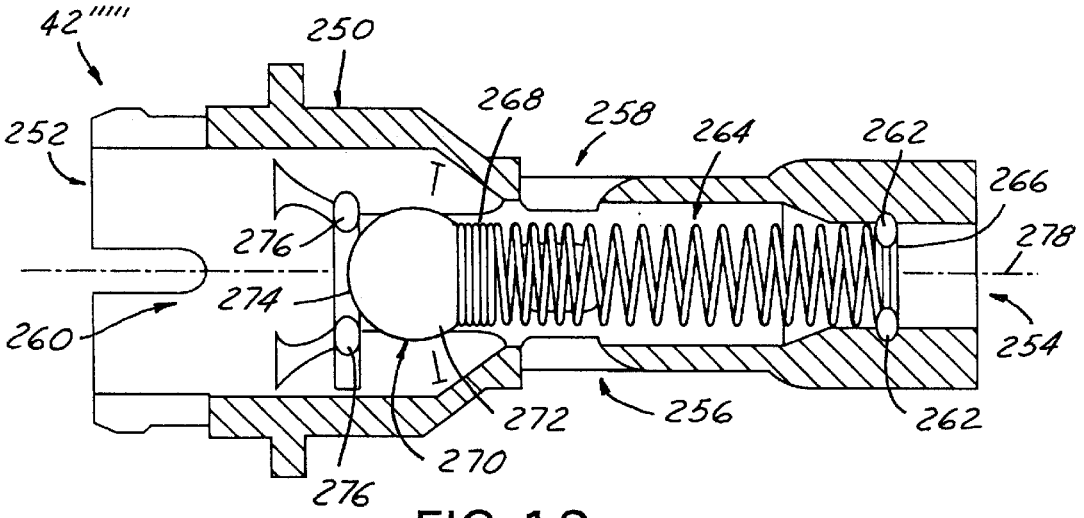
FIG. 12 is a sectional view of the fluid-activatable switch of FIG. 10, wherein the view is taken along the 12—12 line of FIG. 11.
Figure 13:
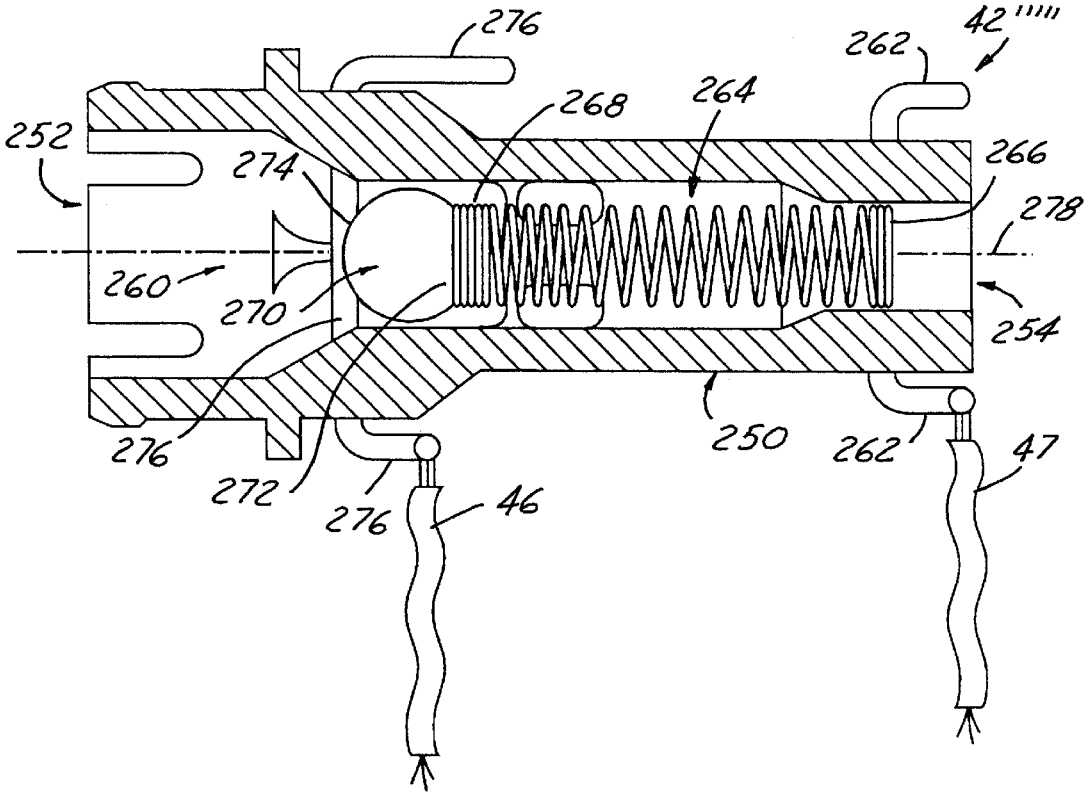
FIG. 13 is another sectional view of the fluid-activatable switch of FIG. 10, wherein the view is taken along the 13—13 line of FIG. 11.

As best shown in FIG. 10, both the first contact 262 and the second contact 276 comprise a separate pair of metal prongs wherein the prongs of each pair are substantially parallel to each other and electrically shorted together. The pairs of prongs are all mounted and exposed within the chamber 260 such that fuel may flow around and between the prongs. The prongs of the second contact 276 provide a means for capturing the plunger ball 270 in the chamber as best illustrated in FIGS. 11 and 12. Furthermore, as illustrated in FIGS. 11 and 13, the plunger ball 270 is closely and slidably received between four axially extending and equally circumferentially spaced-apart ribs 277 to restrain the plunger ball 270 from dithering when fuel flow through the switch 42'''' is low and the switch 42'''' is in an electrically closed position.

The function and operation of the fifth switch 42'''' is substantially similar to the above-described operation of the fourth switch 42'''' of FIGS. 8 and 9 and hence will not be repeated herein.

System Operation

Figure 14:
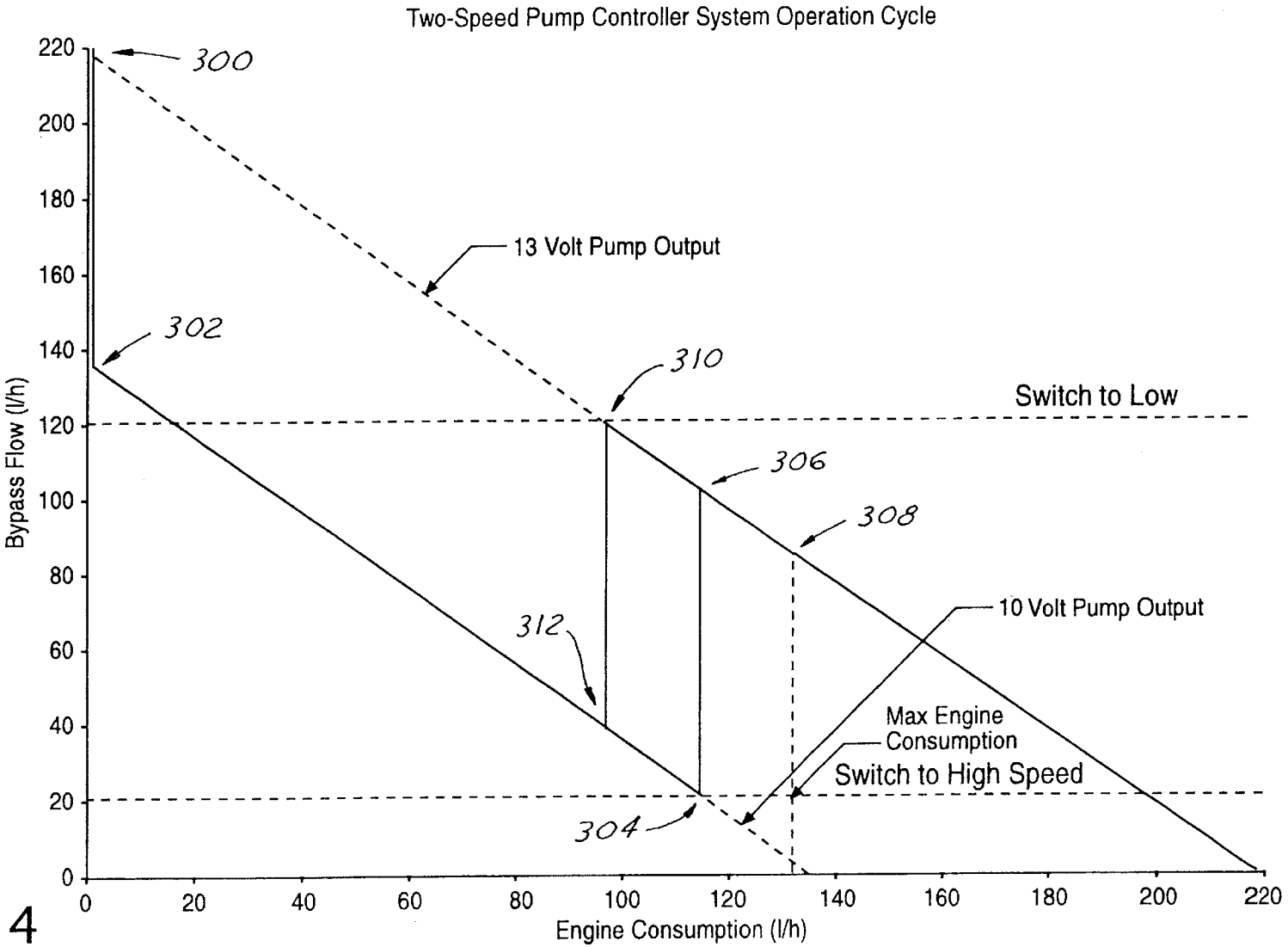
FIG. 14 is a graph illustrating an operational hysteresis characteristic of the system of FIG. 1 with the fluid-activatable switch of FIG. 10.

A further example of the operation of the fuel system 40 with the fifth switch 42'''' and the first electric control circuit 44' is illustrated in the graph of FIG. 14 which shows the operational hysteresis characteristics of the system 40. Assuming that the engine 30, the returnless fuel system 40, and the apparatus 50 have been at rest for some period of time, the point 300 on the graph in FIG. 14 represents the initial start-up of the engine 30. At the initial start-up of the engine 30, the electric motor 18 is turned on and initially operates at the maximum possible voltage (for example, 13 volts) that is deliverable by the electric voltage control circuit 44'. While the electric fuel pump motor 18 runs in such a full-speed mode, the fuel pump 19 supplies fuel under pressure to the fuel supply line 26 at a rate of 220 liters per hour (l/h or lph). If the fuel demand of the engine 30 is negligible at this time, then the flow rate of fuel within the fuel bypass line 34 and through the bypass fuel pressure regulator 36 and the fifth switch 42'''' is about 220 lph as well. This fuel flow rate exerts enough force against the impact side 274 of the plunger 270 so that it moves against the bias of the biasing element 264 to the point where it is no longer in electrical contact with the second contact 276. As a result, the switch 42'''' is in an electrically open position, and the FET 100 in the electric voltage control circuit 44' slips into non-conduction mode and a reduced voltage (for example, 10 volts) is thereby applied to the electric fuel pump motor 18 from the electric voltage control circuit 44'. Consequently, the operating speed of the electric fuel pump motor 18 and the flow rate of fuel delivered by the fuel pump 19 to the fuel supply line 26 is reduced to, for example, 130 lph. Since the fuel demand of the engine 30 is still negligible at this point, the fuel flow rate within the fuel bypass line 34 and the switch 42'''' as regulated by the bypass fuel pressure regulator 36 then drops to 130 lph as well. Point 302 on the graph in FIG. 14 illustrates this particular low-speed mode of operation.

As the fuel demand of the engine 30 increases, the flow of fuel in the bypass fuel line 34 and the switch 42'''' is reduced by the bypass fuel pressure regulator 36. When a predetermined low fuel flow threshold level is eventually reached, for example 20 lph, the biasing force exerted on the plunger 270 by the biasing element 264 becomes larger than the force produced by the fuel flowing through the switch 42'''' via the inlet opening 252. As a result, the plunger 270 moves toward and becomes pressed against the second contact 276 into an electrically closed position again. Consequently, the FET 100 in the electric voltage control circuit 44' slips back into conduction mode and the resistor 102 is thereby electrically shorted out. Thus, the full voltage potential (in this example, 13 volts) between the positive power node 15 and the negative power node 25 is again applied to the electric fuel pump motor 18. Point 304 on the graph in FIG. 14 illustrates this particular mode of operation.

With the maximum possible voltage again being applied to the electric fuel pump motor 18, both the operational speed and fuel output of the fuel pump 19 increases such that, for example, fuel at 115 lph is delivered to the engine 30 and fuel at 105 lph is diverted into the fuel bypass line 34 by the bypass fuel pressure regulator 36 as dictated by the fuel demand of the engine 30. Point 306 on the graph in FIG. 14 illustrates this particular mode of operation.

As the fuel demand of the engine 30 thereafter continues to increase, the fuel flow diverted into the fuel bypass line 34 correspondingly decreases, thereby maintaining the switch 42"" in an electrically closed position and the operational speed of the electric motor 18 and fuel pump 19 at a maximum. Point 308 on the graph of FIG. 14 illustrates this particular mode of operation. Subsequently, as the fuel demand of the engine 30 decreases, the fuel flow diverted into the fuel bypass line 34 correspondingly increases until a predetermined high fuel flow threshold level is attained (for example, 120 lph). Once attained, the force of the fuel flow exerted against the plunger 270 is once again sufficient to overcome the biasing force of the biasing element 264 and thereby separate the plunger 270 from the second contact 276 and change the state of the switch 42"" to an electrically open position. As a result, the FET 100 in the electric voltage control circuit 44' slips into non-conduction mode, and the voltage supplied to the electric fuel pump motor 18 is again reduced, for example, to 10 volts. Point 310 on the graph of FIG. 14 illustrates this particular mode of operation. With the reduced voltage being supplied to the electric fuel pump motor 18, the operational speed and fuel output of the fuel pump 19 is again reduced to a minimum level. At this minimum level, if the fuel demand of the engine 30 remains the same, then the amount of fuel diverted into the fuel bypass line 34 by the bypass fuel pressure regulator 36 is accordingly reduced. Point 312 on the graph of FIG. 14 illustrates this particular mode of operation.

In summary, in operating the fuel system according to the various embodiments described hereinabove, the apparatus 50 is able to apply a current at two different voltage levels to the electric fuel pump motor 18 and thereby modulate the operational speed of the fuel pump 19 in a timed relationship or phase with the changing fuel demands of the engine 30. In this way, the present invention provides a better overall means for delivering an amount of fuel to the engine 30 which better correlates with and more timely or rapidly responds to the actual fuel demand of the engine 30. Because of the time lag between a rapid engine acceleration with its rapid increase in fuel demand and the response of the fuel system in delivering increased maximum fuel flow, the fuel system is designed and operated to normally and virtually always supply some fuel in excess of the engine fuel demand under all operating conditions. Further, it is to be understood that the particular switching speed of the electric voltage control circuit 44 can be controlled to a certain extent by calibrating the electrical values of the circuit elements included therein.

While the present invention has been described in what are presently considered to be the most practical and preferred embodiments and/or implementations, it is to be understood that the invention is not to be limited to the disclosed embodiments, but on the contrary, is intended to cover various modifications and equivalent arrangements included within the spirit and scope of the appended claims, which scope is to be accorded the broadest interpretation so as to encompass modifications and equivalent structures as is permitted under the law. For example, the invention may be utilized in a return type fuel system with the fluid-activatable switch actuated by and responsive to the flow rate of the excess fuel returned from the engine and the control circuit may be a pulse width modulated (PWM) circuit applying a current to the electric motor at two different power levels to modulate the speed of the pump. A suitable PWM control circuit is disclosed in U.S. Pat. No. 5,265,644, the disclosure of which is incorporated herein by reference.

We claim:

1. An apparatus for supplying fuel in a fuel system to an internal combustion engine comprising:

an electric motor for driving a fuel pump;

a fuel pump having an outlet configured to deliver fuel to the engine;

a bypass fuel pressure regulator communicating with the pump outlet to regulate the pressure of fuel supplied to the engine and configured to divert excess fuel flow from the engine in response to the fuel demand of the engine;

a fluid-activatable switch communicating with the pressure regulator and receiving the excess fuel from the pressure regulator and returning the excess fuel to a fuel tank; and an electric control circuit electrically connected to the switch, capable of being electrically connected to an electric voltage power source and to the electric motor for supplying an electric current to the electric motor;

wherein said switch is manipulable into an electrically open position and an electrically closed position as determined by the rate of flow of excess fuel from the pressure regulator; and wherein said control circuit is capable of adjusting the magnitude of the power of the current supplied to the electric motor as dictated by the position of the switch such that the speed of said electric fuel pump motor is modulated in accordance with changes in the rate of flow of excess fuel and the position of the switch.

2. The apparatus according to claim 1, wherein said fluid-activatable switch comprises:

an elongate body having an inlet opening at one end, a stop opening at the opposite end, at least one outlet opening, and a longitudinal chamber in communication with said inlet opening, said stop opening, and said at least one outlet opening;

a plunger, slidingly received within said chamber, having a shoulder portion proximate said at least one outlet opening in said body, and a single electrically conductive contact mounted on said shoulder portion proximate said inlet opening;

an adjustable stop received in said stop opening having a tail portion extending into said chamber and an exposed head portion;

a yieldable and resilient biasing element, received between said plunger and said stop, having a first end bearing and abutting said tail portion of said stop and a second end extending into said chamber and abutting said plunger; and a pair of electrically conductive contacts electrically connected to said electric control circuit and exposed within said chamber of said body substantially between said inlet opening and said at least one outlet opening;

wherein said chamber of said body defines a fuel flow path from said inlet opening to said at least one outlet opening, said single contact and said shoulder portion of said plunger are situated in said fuel flow path and yieldably biased against fuel flowing within said fuel flow path, said plunger is capable of being moved as dictated by the rate of the excess fuel flowing along said fuel flow path such that said switch is in one of said electrically open position and said electrically closed position, and said open position is defined as said single contact being separated from said pair of contacts and said closed position is defined as said single contact being in electrical contact with said pair of contacts.

3. The apparatus according to claim 2, wherein said longitudinal chamber is substantially cylindrical.

4. The apparatus according to claim 3, wherein said inlet opening and said stop opening are substantially aligned with the longitudinal axis of said longitudinal chamber.

5. The apparatus according to claim 3, wherein said shoulder portion of said plunger is substantially cylindrical and has a cross-sectional area that approaches the cross-sectional area of said longitudinal chamber.

6. The apparatus according to claim 2, wherein each of said at least one outlet opening is defined within a common middle portion of said elongate body.

7. The apparatus according to claim 2, wherein said adjustable stop and said stop opening are both threaded such that said stop is adjustably threadingly received in said stop opening.

8. The apparatus according to claim 2, wherein said stop is one of a plug and a cup-shaped closure.

9. The apparatus according to claim 2, wherein said resilient biasing element is a spring.

10. The apparatus according to claim 2, wherein said plunger has a plurality of integral fins in sliding contact with the inner surface of said elongate body.

11. The apparatus according to claim 2, wherein said single electrically conductive contact is an annular disc of metal.

12. The apparatus according to claim 11, wherein said plunger has a stem integral with said shoulder portion and extending toward said inlet opening, and said annular disc is adjustably fixed on said stem proximate the extended end of said stem.

13. The apparatus according to claim 12, wherein said longitudinal chamber is substantially cylindrical, and said inlet opening and said stem are substantially aligned with the longitudinal axis of said longitudinal chamber.

14. The apparatus according to claim 2, wherein said single electrically conductive contact is an annular ring of metal.

15. The apparatus according to claim 14, wherein said plunger has a pocket integral with said shoulder portion and facing said inlet opening, and said annular ring is fixedly seated in said pocket such that said annular ring extends toward said inlet opening partially beyond the confines of said pocket.

16. The apparatus according to claim 2, wherein said pair of electrically conductive contacts is a pair of prongs of metal.

17. The apparatus according to claim 16, wherein said elongate body has a plug opening substantially between said inlet opening and said at least one outlet opening, said fluid-activatable switch includes an electrically insulative plug casing sealingly situated within said plug opening, and said pair of prongs is mounted in said plug casing such that said prongs are at least partially exposed within said longitudinal chamber and are electrically connected to said electric voltage control circuit.

18. The apparatus according to claim 2, wherein said pair of electrically conducive contacts is a pair of flexible prongs of metal and sealingly mounted in the wall of said longitudinal chamber such that said flexible prongs protrude into said chamber substantially between said inlet opening and said at least one outlet opening.

19. The apparatus according to claim 18, wherein said elongate body includes a plurality of laminar flow guide structures integral with the wall of said longitudinal chamber and situated within said chamber proximate said inlet opening, and at least one of said laminar flow guide structures has a stop surface for physically limiting the extent of flexing of at least one of said flexible prongs when said fluid-activatable switch is in said electrically closed position.

20. The apparatus according to claim 1, wherein said electric control circuit comprises:

an electrically resistive circuit element; and means for electrically sensing the position of said fluid-activatable switch and selectively connecting said resistive circuit element in electrical series with said electric motor and to said electric voltage power source as dictated by said sensed position of said switch.

21. The apparatus according to claim 20, wherein said electrically resistive circuit element is a resistor.

22. The apparatus according to claim 20, wherein said position sensing and selective connecting means comprises a field-effect transistor.

23. The apparatus of claim 1, wherein said fluid-activatable switch comprises:

an elongate body having an inlet opening at one end, an end outlet opening at the opposite end, at least one side outlet opening, and a longitudinal chamber in communication with said inlet opening, said end outlet opening, and said at least one side outlet opening;

an electrically conductive first contact, electrically connected to said electric control circuit, mounted and exposed within said chamber of said body proximate said end outlet opening;

an electrically conductive resilient biasing element having a first end electrically attached to said first contact and a second end extending into said chamber;

an electrically conductive plunger, slidingly received within said chamber, having a biased side electrically attached to said second end of said biasing element, and an impact side opposite said biased side and movably situated substantially between said inlet opening and said at least one side outlet opening in said body; and an electrically conductive second contact, electrically connected to said electric control circuit, mounted and exposed within said chamber of said body substantially between said inlet opening and said at least one side outlet opening;

wherein said chamber of said body defines a fuel flow path from said inlet opening to said outlet openings, said plunger is situated within said fuel flow path and yieldably biased against fuel flowing within said fuel flow path, said plunger is capable of being moved as dictated by said fuel flowing within said fuel flow path such that said switch is in one of said electrically open position and said electrically closed position, and said open position is defined as said plunger being separated from said second contact and said closed position is defined as said plunger being in electrical contact with said second contact.

24. The apparatus according to claim 23, wherein said longitudinal chamber is at least substantially funnel-shaped between substantially said second contact and said at least one side outlet opening and cylindrical between substantially said at least one side outlet opening and said first contact.

25. The apparatus according to claim 23, wherein each of said at least one side outlet opening is defined within a common middle section of said elongate body between said first contact and said second contact.

26. The apparatus according to claim 23, wherein said resilient biasing element is a helical spring of metal.

27. The apparatus according to claim 23, wherein said electrically conductive plunger is substantially spherical.

28. The apparatus according to claim 27, wherein said longitudinal chamber is substantially cylindrical proximate said at least one side outlet opening, and the diameter of said spherical plunger substantially approaches the diameter of said longitudinal chamber proximate said at least one side outlet opening.

29. The apparatus according to claim 27, wherein said electrically conductive spherical plunger is a ball of metal.

30. The apparatus according to claim 23, wherein said electrically conductive second contact comprises a pair of metal prongs electrically shorted together.

31. The apparatus accordingly to claim 30, wherein said electrically conductive first contact comprises another pair of metal prongs electrically shorted together.

32. The apparatus according to claim 31, wherein said metal prongs of said second contact are substantially parallel to each other, and said metal prongs of said first contact are substantially parallel to each other.

33. The apparatus according to claim 1 wherein the fuel system is a returnless fuel system.

34. The apparatus according to claim 1 wherein the electric control circuit is configured to adjust the magnitude of the voltage of the current applied to the electric motor as dictated by the position of the switch.

35. The apparatus according to claim 1 wherein the control circuit is configured as a pulse width modulation circuit to adjust the power of the current applied to the electric motor as dictated by the position of the switch.

* * * * *